United States Patent [19]

Schuster

[11] Patent Number: 4,773,540

[45] Date of Patent: Sep. 27, 1988

[54] CARTON PANEL LOCKING ARRANGEMENT

[75] Inventor: Richard L. Schuster, Monroe, La.

[73] Assignee: Manville Corporation, Denver, Colo.

[21] Appl. No.: 91,142

[22] Filed: Aug. 31, 1987

[51] Int. Cl.[4] ..... B65D 5/02

[52] U.S. Cl. ..... 206/427; 206/140; 229/40

[58] Field of Search ..... 229/40; 206/427, 434, 206/140

[56] References Cited

U.S. PATENT DOCUMENTS

| | | | |
|---|---|---|---|
| 3,199,765 | 8/1965 | Locke | 229/40 |
| 3,257,066 | 6/1966 | Williams | 229/40 |
| 3,356,282 | 12/1967 | Layne, Sr. | 229/40 |
| 3,869,079 | 3/1975 | Oglesbee | 229/40 |
| 3,923,236 | 12/1975 | Calvert | 229/40 |
| 4,577,799 | 3/1986 | Oliff | 229/40 |

FOREIGN PATENT DOCUMENTS

| | | | |
|---|---|---|---|
| 3935 | 9/1979 | European Pat. Off. | 229/40 |

*Primary Examiner*—Stephen Marcus
*Assistant Examiner*—Gary E. Elkins
*Attorney, Agent, or Firm*—John D. Lister; Cornelius P. Quinn; Gregory A. Evearitt

[57] ABSTRACT

Interlocking end panel flaps of a carton having locking tabs containing diagonal fold lines allowing the wide toe portion of the tabs to fold back when inserting the tabs in locking apertures which are narrower than the width of the toe portion. Holding tabs connected to the aperture edge adjacent the location of the toe portions of the locking tabs extend completely across the width of the aperture in a straight line to better hold the locking tab in place.

6 Claims, 2 Drawing Sheets

FIG. 4
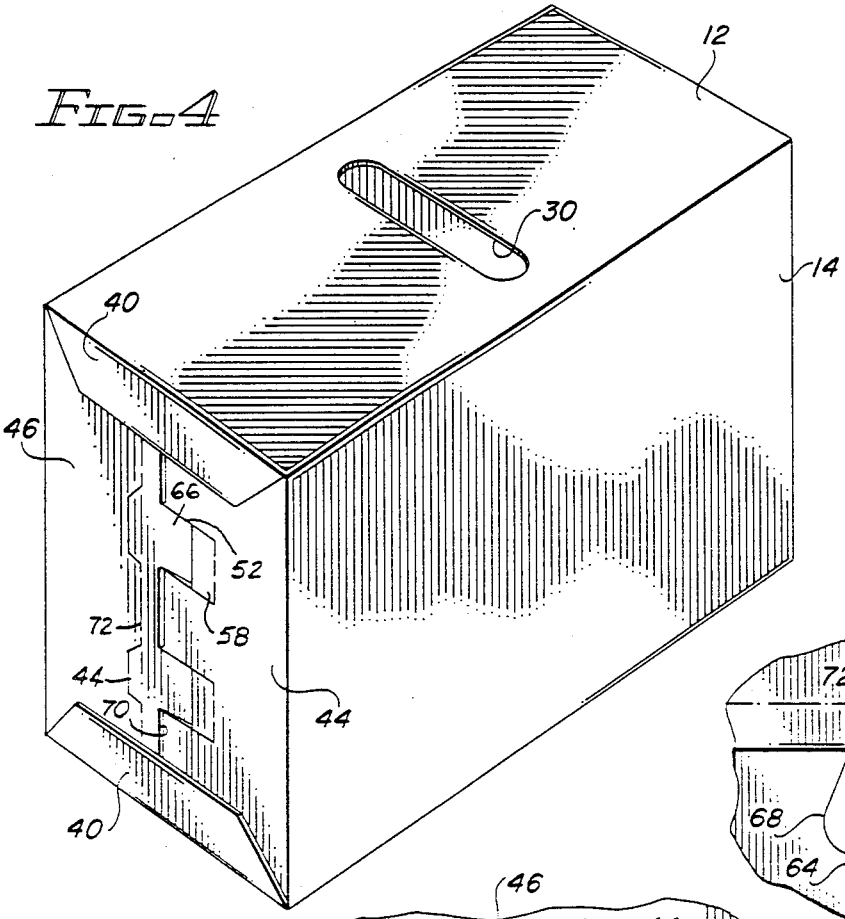
FIG. 6A
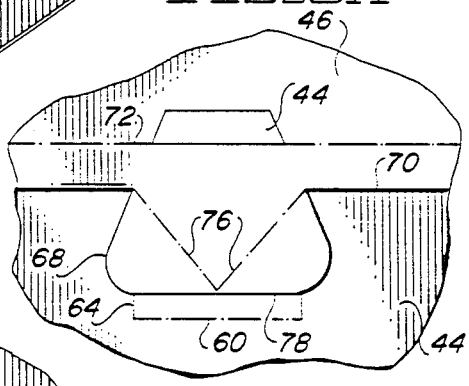
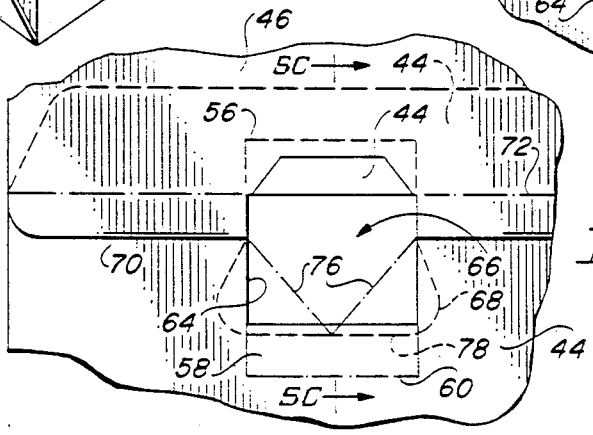
FIG. 6B
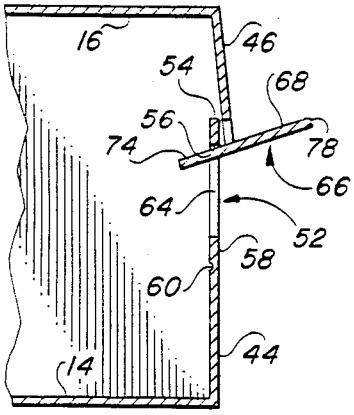
FIG. 5A
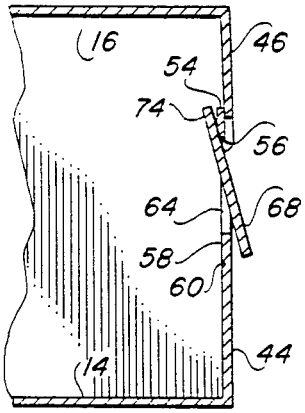
FIG. 5B
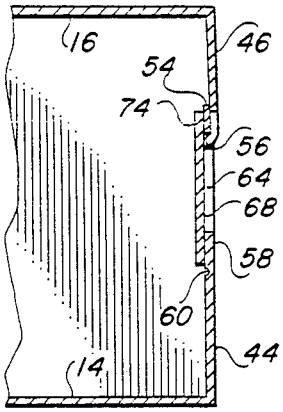
FIG. 5C

CARTON PANEL LOCKING ARRANGEMENT

FIELD OF THE INVENTION

This invention relates to the interlocking of overlapping end panel flaps which form the end panel of a carton. More particularly, it relates to a new locking tab design to be incorporated in one of the end panel flaps and a new locking aperture design to be incorporated in the other end panel flap, resulting in an improved locking arrangement for holding the end panel flaps together.

BACKGROUND OF THE INVENTION

The overlapping flaps which form the end panel of a beverage can carton are commonly held in place by a locking arrangement between coacting tabs on the outer end panel flap and apertures in the inner end panel flap. Each locking tab has a heel portion, which is held in place adjacent a locking edge of its associated aperture, and a toe portion, which is wider than the aperture into which it is inserted.

One problem with this type of lock stems from the fact that the toe portion of the locking tab must be substantially wider than the opening of the locking aperture in order to prevent the tab from being pulled out during handling or shipping of the carton. It also has to be wide enough to allow for slight misalignment of the tab and the aperture during carton fabrication in the packaging machine. Countering this requirement, however, is the need to be able to readily insert the tabs into the apertures so as avoid carton failures due to inadequately inserted tabs. This has resulted in attempts to ease the insertion of the tabs without decreasing the width of the toe portion to the point where the holding power of the locking mechanism is impaired.

One such attempt is disclosed in U.S. Pat. No. 3,955,748 issued to Calvert. According to the design of this patent the bottom edge of the aperture is provided with a centrally located notch and the tab is provided with a centrally located fold line running the length of the tab. When the tab is first inserted its movement into the aperture is impeded by its contact with the paperboard immediately surrounding the aperture, causing the tab to fold along the longitudinal fold line and to enter the aperture through the clearance notch. One problem with this arrangement is that the tab has to fold quite sharply in order to enter the clearance notch, but the design of the tab, wherein the fold line extends into a region of the tab which is connected to the panel flap itself, prevents the tab from having this capability. Another problem with the arrangement is that if the tab is misaligned to the extent that only one side of the toe portion enters the aperture, an event made more likely by the requirement that the toe portion enter the aperture through the clearance notch, the contour of the bottom edge of the aperture is not enough to assure that the tab will be held in place.

Another locking arrangement intended to improve upon the design described above is disclosed in U.S. Pat. No. 4,577,799 issued to Oliff. In that arrangement a holding tab is provided at the bottom edge of the aperture to prevent the locking tab from being forced out of the aperture. To facilitate the entry of the toe portion of the tab into the aperture the tab is provided with a longitudinal fold line as in the Calvert design and the tab edge is made arcuate in shape. The tab does not have to fold as much as it does in the Calvert arrangement because the toe portion has additional space in which to enter the aperture at the edges of the aperture adjacent the ends of the arcuate holding tab, as shown in FIG. 5 of the drawing. The arcuate shape of the holding tab, however, restricts contact between the locking tab and the holding tab to a relatively small centrally located area of the locking tab. Further, because of the limited ability of the locking tab to fold there is no assurance that the tab will be inserted sufficiently in the event of misalignment of the tab and the aperture.

While it would obviously be desirable to provide a holding tab that affords greater locking tab contact, it does not appear to be feasible in view of the inability of the toe portion of the locking tab to fold to the extent necessary to move past such a holding tab.

BRIEF SUMMARY OF THE INVENTION

This invention overcomes the limitations of the prior art designs by providing a holding tab which extends across the width of the locking aperture to provide a more secure arrangement at all points along the width of the aperture. The toe portion of the locking tab is able to move past the holding tab and through the aperture due to the presence of diagonal fold lines in the toe portion which extend from the leading edge of the toe portion to the side edges of the locking tab. By this arrangement the portions of the locking tab lying outwardly of the diagonal fold lines fold back about the diagonal fold lines when the relatively wide locking tab is forced through the relatively narrow locking aperture.

Other features and aspects of the invention, as well as its various benefits, will be made clear in the more detailed description of the invention which follows.

BRIEF DESCRIPTION OF THE DRAWINGS

FIG. 4 is a pictorial view of a carton formed from the blank of FIG. 1;

FIG. 5A is an enlarged partial sectional view showing the initial step in inserting the locking tab of the outer end panel flap into the locking aperture of the inner end panel flap;

FIG. 5B is an enlarged partial sectional view similar to that of FIG. 5A, but showing the locking tab in a later state of insertion;

FIG. 5C is a sectional view similar to that of FIG. 5A, but showing the locking tab in its fully inserted position;

FIG. 6A is an enlarged partial end elevation of the locking tab and locking aperture portions of the end panel flaps corresponding to the state of locking tab insertion illustrated in FIG. 5B; and FIG. 6B is a view similar to that of FIG. 6A, but showing the locking tab in its fully inserted position, the outline of hidden parts being shown in dotted lines for the purpose of clarity.

DESCRIPTION OF THE INVENTION

Figure 1:
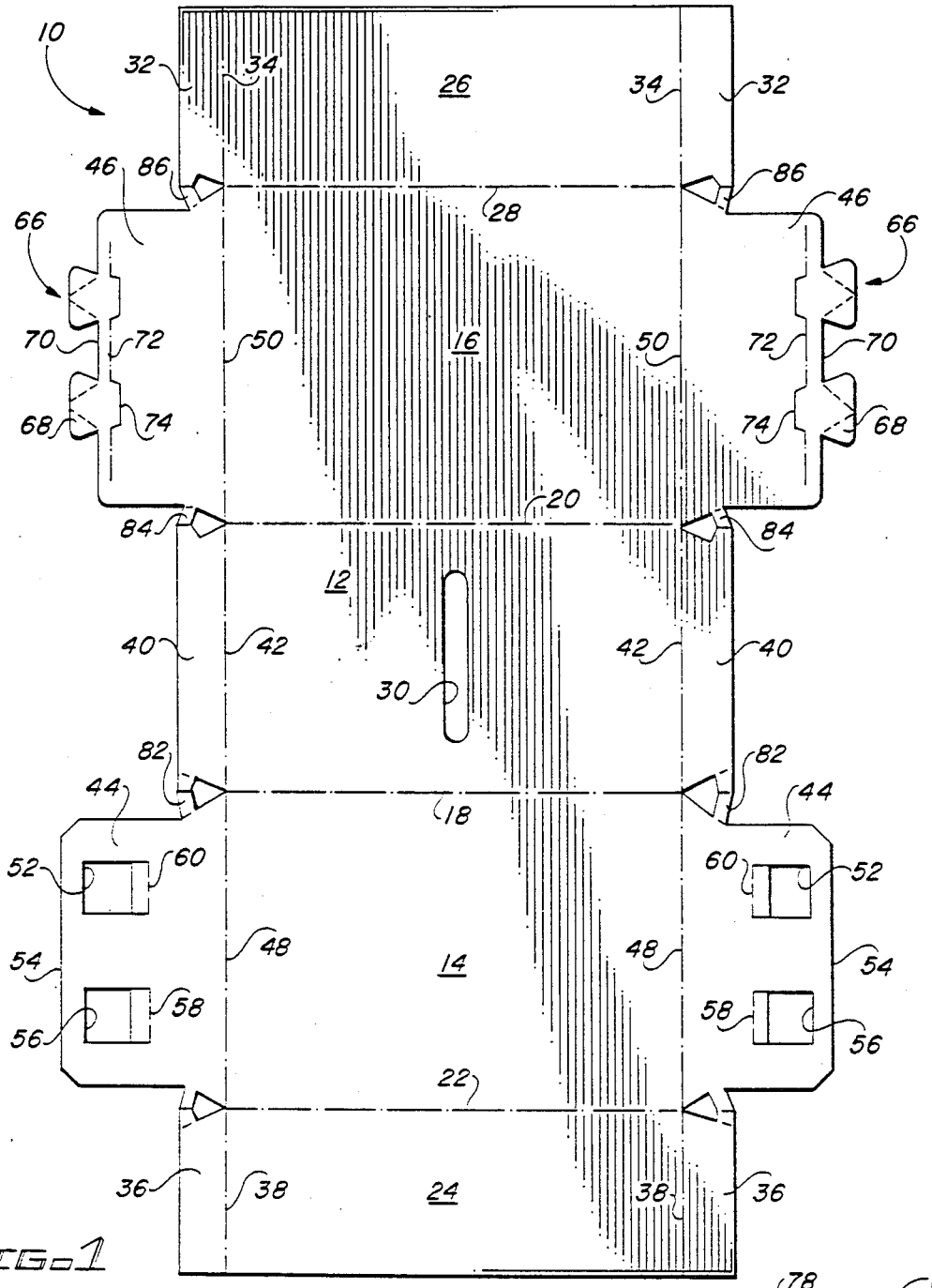
FIG. 1 is a plan view of a production blank for forming a carton incorporating the locking mechanism of the present invention.

Referring to FIG. 1, a carton blank 10 includes a central section 12 connected to intermediate sections 14 and 16 by score lines 18 and 20, respectively. Connected to the intermediate section 14 by score line 22 is end section 24. Similarly, end section 26 is connected to intermediate section 16 by score line 28. The central section 12 is intended to become the top panel of a carton formed from the blank and a handle opening 30 is provided in the middle portion of the central section to facilitate lifting of the carton. Intermediate sections 14 and 16 are intended to form the side panels of the carton and end sections 24 and 26 are designed to be glued together to form the bottom panel of the carton. Although not shown in the drawing because they form no part of the invention, tear lines may be provided if desired in the intermediate sections to facilitate unloading of the cartons.

The end panels of the carton are formed from flaps connected by score lines to the various sections of the blank. Thus closure flaps 32, connected to end section 26 by score lines 34, and closure flaps 36, connected to end section 24 by score lines 38, would be folded in unison about their score lines 34 and 38 after the sections 24 and 26 were glued together. Similarly, closure flaps 40, connected to central section 12 by score lines 42, would be folded about their score lines 42 at the same time as the closure flaps 32 and 36.

Figure 2:
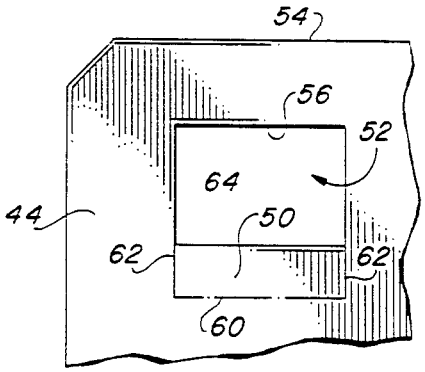
FIG. 2 is an enlarged partial plan view of one of the locking apertures of the locking mechanism of the present invention.

In addition, end panel flaps 44 and 46 are connected to intermediate sections 14 and 16 by score lines 48 and 50, respectively. As can be seen in FIG. 1, and in more detail in FIG. 2, each end panel flap 44 contains two similar locking apertures 52 spaced from the unconnected outer edge 54 of the flap 44. The outermost edge 56 of an aperture 52 is the locking edge of the aperture. Located at the opposite or innermost edge of the aperture 52 is a holding tab 58 which is connected to the flap 44 by a score line 60, the side edges of the holding tab 58 being formed by a slit 62 which is a continuation of the side edges 64 of the aperture 52. The holding tab 58 is thus able to pivot about the score line 60 during the locking of the end panel flaps 44 and 46, as explained in more detail hereinafter.

Figure 3:
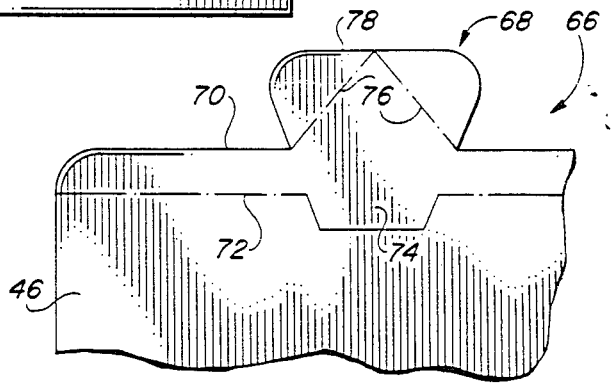
FIG. 3 is an enlarged partial plan view of one of the locking tabs of the locking mechanism of the present invention.

Referring now to FIGS. 1 and 3, each end panel flap 46 contains two similar locking tabs 66 having toe portions 68 which extend outwardly from the unconnected outer edge 70 of the flap 46. The outer edge 70 and the toe portions 68 of the locking tabs 66 are connected to the main body of the end panel flap 46 by fold line 72, allowing the portions outwardly of the fold line 72 to be pivoted or folded about the fold line out of the plane of the end panel flap 46. Extending inwardly toward the fold line 50 is a heel portion 74 also capable of being folded out of the plane of the end panel flap 46. Fold lines 76 extend from the central portion of the leading edge 78 of the toe portion 68 diagonally to approximately the juncture of the toe portion 68 and the outer edge 70 of the end panel flap 46. The functions of the various parts of the locking tab will be explained in more detail hereinafter.

Still referring to FIG. 1, the various flaps described above are connected to each other by connecting webs which facilitate the end panel forming operation. Webs 80 connect the flaps 36 and 44, webs 82 connect the flaps 44 and 40, webs 84 connect the flaps 40 and 46, and webs 86 connect the flaps 46 and 32. The webs are connected to the flaps along fold lines.

In forming a package a carton blank, the end sections 24 and 26 of which have been glued together, is sent through the packaging machine. The machine opens the glued blank to form a sleeve or tube and the beverage cans are loaded into the sleeve through the open ends thereof. Later, the closure flaps are folded in, bringing the end panel flaps into position for the locking tabs to be inserted into the locking apertures.

When the carton has been fully formed it appears as in FIG. 4, wherein the various panels and components bear like reference numerals to those used in connection with the blank of FIG. 1. It can be seen that the locking tabs 66 have been inserted into the apertures 52 and that the ends of the toe portions have been covered by the holding tabs 58. The closure flaps 40 are visible at the edges of the end panel flaps 44 and 46.

Referring now to FIG. 5A, the positions of the end panel flaps 44 and 46 at the initiation of the locking mechanism is illustrated. The outer edge portion of the end panel flap 46, which carries the locking tabs 66, overlaps the outer edge portion of the end panel flap 44, which carries the locking apertures 52. The locking tab 66 has been pivoted out of the plane of the flap 46 about the score line 72 and the heel portion 74 has been inserted through the outermost portion of the aperture 52 adjacent the locking edge 56 of the aperture.

By pivoting the locking tab 66 about the score line 72 in a direction to move the tab back into the plane of the end panel flap 46, the outer face of the heel portion 74 engages the locking edge 56. Continued pivoting movement brings the locking tab into the position shown in FIG. 5B, wherein the outer face of the heel portion engages or is about to engage the inner face of the flap 44 between the outermost edge 54 of the flap 44 and the locking edge 56 of the aperture 52. At this point the toe portion 68 of the locking tab has contacted the outer face of the holding tab 58. As shown in FIG. 6A, which corresponds to the position of elements shown in FIG. 5B, the side edges of the toe portion 68 of the locking tab 66 extend beyond the edges 64 of the aperture. The edges 64 thus form a barrier to the entry of the toe portion into the aperture. In addition, the holding tab 58, which extends completely across the width of the aperture, extends up beyond the leading edge of the toe portion, also acting as a barrier to the entry of the toe portion of the locking tab into the locking aperture.

Continued pressure on the locking tab tending to pivot the tab even more about its fold line 72 in a direction to move the tab back into the plane of the end panel flap 46 causes the toe portions located outwardly of the diagonal fold lines 76 to be folded upwardly about the fold lines 76, causing the effective width of the toe portion to be reduced. At the same time the holding tab 58 is pivoted down about the score line 60. Still more continued pressure on the tab will cause the toe portion to fold about its diagonal fold lines 76 even more, and the holding tab 58 to pivot down about its score line 60 even more, until the toe portion snaps through the side edges of the aperture and moves down over the free end of the holding tab. At that point the resiliency or memory of the material at the folds 76 and the score line 60 causes the toe portion to fold back in the opposite direction about the fold lines 76 and the holding tab to fold back in the opposite direction about the score line 60. It should be understood that the various movements of the locking components described above are caused by mechanical elements of the packaging machine operating at very high speeds and are not done by hand. The machinery for causing such movements is well known in the art and does not form a part of this invention.

Referring now to FIGS. 5C and 6B, which illustrate the final locked position of the locking tab in the associated aperture, it can be seen that the toe portion 68 of the locking tab 66 has been secured in place behind the portions of the panel flap 44 adjacent the aperture 52. Due to the action of the diagonal fold lines, the toe portion has been able to slide past the holding tab even though the holding tab extends at a constant height completely across the width of the aperture. The part of the toe portion adjacent the leading edge 78 has been completely covered by the holding tab 58 to prevent the locking tab from escaping out through the aperture. The result of this arrangement is to enable the engaged locking tabs and locking apertures to resist the shipping and handling stresses tending to withdraw the tabs from the apertures so as to retain the overlapping end panel flaps in interlocked condition.

It should now be clear that the holding tab of the present invention is able to cover and hold in place the entire exposed width of the toe portion of the locking tab. This is made possible by the ability of the toe portion to fold about its diagonal fold lines so as to enable the toe portion to be inserted into the aperture despite the barrier presented by the holding tab extending out to the side edges of the aperture. Because the diagonal fold lines are located in an area of the locking tab which permits the toe portions lying outwardly of the fold lines to fold back upon the locking tab to a much greater degree than would a longitudinally arranged fold line, the locking tab is able to squeeze through the small opening.

It should be obvious that although a preferred embodiment of the invention has been disclosed, changes to certain of the details of the embodiment may be made without departing from the spirit and scope of the invention as defined in the claims.

What is claimed is:

1. In a beverage container carton having an end panel comprised of inner and outer overlapping end panel flaps, wherein each end panel flap has a first edge foldably connected to the carton and an opposite unconnected second edge, and wherein each end panel flap has an outer face directed away from the interior of the carton and an inner face directed toward the interior of the carton, means for interlocking the inner and outer end panel flaps, comprising:

a locking tab joined to the outer end panel flap along a fold line generally parallel to the first edge of the outer end panel flap, the locking tab having an outer face directed away from the interior of the carton and an inner face directed toward the interior of the carton, the locking tab having an integral toe portion located outwardly of the fold line and an integral heel portion located between the fold line and the first edge of the outer end panel flap, the toe portion having a leading edge and side edges connecting the leading edge to the second edge of the outer end panel flap;

the inner end panel flap containing a locking aperture generally aligned with the locking tab, the aperture having a locking edge spaced from the second edge of the inner end panel flap and having an oppositely facing edge;

a holding tab connected to the oppositely facing edge of the locking aperture and extending across the width of the aperture, the holding tab having an outer face directed away from the interior of the carton and an inner face directed toward the interior of the carton;

the outer face of the heel portion of the locking tab contacting the inner face of the inner end panel flap between the locking edge of the locking aperture and the second edge of the inner end panel flap;

the width of the leading edge of the toe portion of the locking tab being greater than the width of the locking aperture;

the inner face of the holding tab contacting the outer face of the toe portion of the locking tab; and diagonal fold lines in the toe portion of the locking tab extending from the leading edge of the toe portion to the side edges of the locking tab, whereby the portions of the locking tab lying outwardly of the diagonal fold lines fold back about the diagonal fold lines when the relatively wide locking tab is forced through the relatively narrow locking aperture to interlock the end panel flaps.

2. Means for interlocking the inner and outer end panel flaps in a carton according to claim 1, wherein the holding tab has an unattached edge opposite the connection of the holding tab to said oppositely facing edge of the locking aperture, the unattached edge being spaced from said oppositely facing edge of the locking aperture a substantially constant distance throughout the width thereof.

3. Means for interlocking the inner and outer end panel flaps in a carton according to claim 1, wherein the leading edge of the toe portion has a midpoint and wherein the diagonal fold lines in the toe portion of the locking tab extend generally from the midpoint of the leading edge of the toe portion to the side edges of the locking tab.

4. Means for interlocking the inner and outer end panel flaps in a carton according to claim 3, wherein the diagonal fold lines extend to the side edges of the locking tab in the region of the juncture of the side edges of the locking tab and the second edge of the outer end panel flaps.

5. Means for interlocking the inner and outer end panel flaps in a carton according to claim 1, wherein the inner end panel flap contains two apertures of similar size and shape and the outer end panel flap contains two locking tabs of similar size and shape.

6. Means for interlocking the inner and outer end panel flaps in a carton according to claim 1, wherein the holding tab is hinged for folding along a fold line coinciding with the connection of the holding tab to said oppositely facing edge of the locking aperture.

* * * * *